US011554307B1

(12) United States Patent
Talv

(10) Patent No.: US 11,554,307 B1
(45) Date of Patent: Jan. 17, 2023

(54) BOXING CHIN, BOXING AND MARTIAL ARTS TRAINING ACCESSORY

(71) Applicant: Ristjan Talv, North Miami, FL (US)

(72) Inventor: Ristjan Talv, North Miami, FL (US)

(73) Assignee: Ristjan Talv, North Miami, FL (US)

( * ) Notice: Subject to any disclaimer, the term of this patent is extended or adjusted under 35 U.S.C. 154(b) by 0 days.

(21) Appl. No.: 17/013,573

(22) Filed: Sep. 5, 2020

Related U.S. Application Data

(60) Provisional application No. 62/895,959, filed on Sep. 4, 2019.

(51) Int. Cl.
*A63B 69/20* (2006.01)

(52) U.S. Cl.
CPC ..... *A63B 69/305* (2022.08); *A63B 2209/10* (2013.01)

(58) Field of Classification Search
CPC ..... A63B 69/26; A63B 69/004; A63B 2069/0042; A63B 2069/0044; A63B 69/20–345
See application file for complete search history.

(56) References Cited

U.S. PATENT DOCUMENTS

| | | | | | |
|---|---|---|---|---|---|
| 737,889 | A * | 9/1903 | Yoerger | A63B 69/205 | 482/86 |
| 1,637,561 | A * | 8/1927 | French | A63B 69/201 | 482/86 |
| 4,991,231 | A * | 2/1991 | Swift | A63B 69/004 | 2/18 |
| 5,281,191 | A * | 1/1994 | DeSousa | A63B 69/34 | 473/442 |
| 5,498,189 | A * | 3/1996 | Townsend | A61B 5/1176 | 446/100 |
| 5,607,377 | A * | 3/1997 | Wilkinson | A63B 5/11 | 482/27 |
| 5,792,032 | A * | 8/1998 | Williams | A63B 69/34 | 482/83 |
| 5,971,398 | A * | 10/1999 | Broussard | A63B 69/34 | 273/408 |
| 6,971,943 | B1 * | 12/2005 | Schulze | A63H 3/14 | 446/175 |
| 7,789,810 | B2 * | 9/2010 | Le | A63B 69/004 | 482/83 |
| 10,398,959 | B2 * | 9/2019 | Hall | A63B 69/34 | |
| 10,493,346 | B2 * | 12/2019 | Hall | A63B 69/206 | |
| 10,709,951 | B2 * | 7/2020 | Khan | A63B 69/32 | |
| 2005/0244795 | A1 * | 11/2005 | Long | A63B 69/32 | 434/23 |

(Continued)

OTHER PUBLICATIONS

Combat Sports 45 lb. Double End Heavy Bag "https://www.amazon.com/Combat-Sports-Double-End-Heavy-Pound/dp/B005Z38UKE" Dec. 22, 2011 (Year: 2011).*

*Primary Examiner* — Nyca T Nguyen
(74) *Attorney, Agent, or Firm* — John Rizvi, P.A.

(57) ABSTRACT

A boxing training accessory comprises a hand held punching pad with an image of a human face that has a small boxing bag hanging from a lower part of it, representing a human chin/jaw. The accessory provides a more specific target for a user to practice striking techniques and striking combinations while also providing a more realistic look and feel. The training accessory is useful across a range of combat sports including boxing, kickboxing, muay thai, karate, taekwondo, MMA and others.

5 Claims, 7 Drawing Sheets

(56) References Cited

U.S. PATENT DOCUMENTS

| | | | | |
|---|---|---|---|---|
| 2008/0182729 | A1* | 7/2008 | Ziska | A63B 69/34<br>482/89 |
| 2010/0267526 | A1* | 10/2010 | Baschnagel | A63B 21/1627<br>482/86 |
| 2013/0296141 | A1* | 11/2013 | Partlo | A63B 69/20<br>482/84 |
| 2015/0057132 | A1* | 2/2015 | Pedone | A63B 69/34<br>482/83 |
| 2015/0165295 | A1* | 6/2015 | Rea | A63B 69/205<br>482/87 |
| 2018/0296897 | A1* | 10/2018 | Horn | A63B 69/002 |
| 2019/0009160 | A1* | 1/2019 | Penna | A63B 69/208 |

* cited by examiner

BOXING CHIN, BOXING AND MARTIAL ARTS TRAINING ACCESSORY

CROSS-REFERENCE TO RELATED APPLICATIONS

The present application claims the benefit of U.S. Provisional Patent Application Ser. No. 62/895,959, filed on Sep. 4, 2019, which is hereby incorporated by reference in it's entirety.

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

Field of the Invention

The present invention belongs to the technical field of the fitness equipment and in particular to a variety of different martial art training accessories (aids) that are intended for use as a boxer target.

Background

Boxing, kickboxing and other martial art sports, referred to herein collectively as "boxing" sports, require a high degree of physical training. Reaction time is of paramount importance in all martial art forms. As a result, the participants in these sports require a means of maintaining and improving the associated physical skills. In boxing, or in any other martial art form, it is extremely important to learn how to punch/strike accurately, quickly and choosing the right distance for it.

The most effective blow that a boxer must learn is the accurate punch to the jaw or chin area, because it has the best chance for a knockout and helps to win the competition, as we know from the history of boxing. In order to hit the chin/jaw accurately, it must be practiced during the workout repetitively, and this blow needs high accuracy and speed, also the right distance and right angle.

In the past, boxers generally practiced to improve their punching skills and reaction timing skills by punching heavy boxing bags or other types of passive targets. Practicing on heavy boxing bags or other passive targets, boxers can insure themselves, more specifically their joints and muscles. And after practicing for years, these injuries can become the chronic pain spots at older age. Alternatively, boxers practicing their skills by sparring against another fighter. The most difficult part of sparring is to give the boxer a realistic workout, without risking injury to the boxer or the sparring partner.

Various other devices and methods have been used for training in boxing, such as focus mitts or pads, handheld punching pads, also floor-mounted, ceiling-mounted or doorway-mounted punching balls and bags. However, the use of focus mitts and punching pads by a trainer can lead to an injury a boxer's joints and a wear and tear on the trainer's body due to the repeated impact of punches and kicks. While the mounted punching balls and bags reduce risk of harm to a boxer, they are fairly limited in that they only sway back and forth when punched, but are essentially stationary. Also the past available devices are large in size or the punchable area is too large to be compared to a boxer's chin or jaw. Therefore, practicing accuracy and eye-hand coordination on these devices has not been possible or has been limited.

Accordingly, there is need for a solution to at least one of the aforementioned problems. For instance, there is an established need for a more specific target for a user to practice striking techniques and striking combinations, which provides a realistic workout, without risking injury to the boxer or the sparring partner.

SUMMARY OF THE INVENTION

The present invention provides a handheld boxing training equipment, that is a kind of handheld punching pad/mitt with a handle on the back that has a small boxing bag, referred herein to as "Boxing Chin", hanging from the bottom part of the device, which allows the boxing bag or boxing chin to move back and forth and side to side when punched. Also, the boxing bag or boxing chin has less resistance to the punch than any other handheld boxing training device available now, which helps to prevent a possible injury to the boxer's hand/wrist, joints or muscles, etc. The boxing chin is in similar size and shape of a human chin/jaw. The handheld punchable pad would have a core that will be made of wood, plastic or other solid but not heavy material, to help keeping the shape and form of the product, which is covered by cushiony material, that would be overlaid leather or similar durable material. The front part of the pad would be in the shape of a human face or an image of a human face will be printed on it, while the chin/jaw wouldn't be included on the pad. The device would have a handle on the back side the pad. The hanging boxing chin would be attached to the core of the pad and the device as a whole would complete the imitation of a human face. The boxing chin would be made of leather and filled with sand, rubber filler or similar material.

The device can also be easily attached to a wall-mounted bracket or within any open doorway that has a molding/casing with elastic bands or ropes. The size and shape of the hanging boxing chin makes it possible to practice precisely the punch to the jaw/chin. The device could be used with a trainer or individually. Exercising with a trainer allows the trainer by holding and moving the device to mimic the opponent's movements (move up or down, retreat, coining forward, move side to side, etc.) while the trainee/student can practice the stroke to the jaw/chin while also moving around. The trainee can practice this stroke/punch at different angles and distances using different techniques, while developing the accuracy, timing and power of the blows delivered, not only by hands, but also by the elbows and feet. Individually the trainees can practice their own movements in front and around the opponent, while practicing the strike to the jaw/chin. The size of the boxing chin will allow the trainee to grind their striking accuracy and develop their own most effective style. In addition, different equipment can be used during the training sessions, such as boxing gloves, sparring glove or hand wraps. The invention is an improvement in the field of martial art training equipment.

The foregoing examples of the related art and limitations related therewith are intended to be illustrative and not exclusive. Other limitations of the related art will become apparent to those skilled in the art upon a reading of the specifications and a study of the drawings.

An object of the present invention is to provide a new and improved training accessory for boxers and participants in other martial arts, more specifically boxer's target practicing equipment.

Another object of the present invention is to provide a new and improved training accessory which can be utilized by a boxer to sharpen his/her accuracy and timing of all types of strikes to the chin/jaw area normally thrown by a fighter, including jabs and level hooks, uppercuts and upwardly directed hooks, as well as punches thrown by elbows, knees and feet.

Still another object of the present invention is to provide a new and improved training accessory that can be handheld by the trainer by a handle that is attached to the rear side of the device. This allows the trainer to mimic the opponent's movements so the user can practice and sharpen his/her accuracy and timing of their strikes.

A further object of the present invention is to provide a new and improved training accessory which is easily attachable to the wall mounted bracket or within any open doorway having conventional moulding/casing there around, so as desired height can be chosen by the user for both attachment methods.

A still further object of the present invention is to provide a new and improved training accessory that is safe to be used by all martial arts enthusiasts and helping to reduce injuries occurring during training sessions.

The training accessory of the present invention is constructed as follows: a handheld padded punching pad, which have a wooden or plastic inner core, covered by layer of cushiony padding material which is overlaid with leather. Small leather boxing bag filled with sand is attached to the core of the punching pad, it would hang downwards which allows it to provide a bounceback effect when a blow is landed.

The following embodiments and aspects thereof are described and illustrated conjunction with systems, tools and methods which are meant to be exemplary and illustrative and not limiting in scope. In various embodiments one or more of the above described problems have been reduced or eliminated while other embodiments are directed other improvements. In addition to the exemplary aspects and embodiments described above, further aspects and embodiments will become apparent by the drawings and by study of the following description.

BRIEF DESCRIPTION OF THE DRAWING FIGURES

DETAILED DESCRIPTION OF THE INVENTION

Nomenclature

Figure 1:
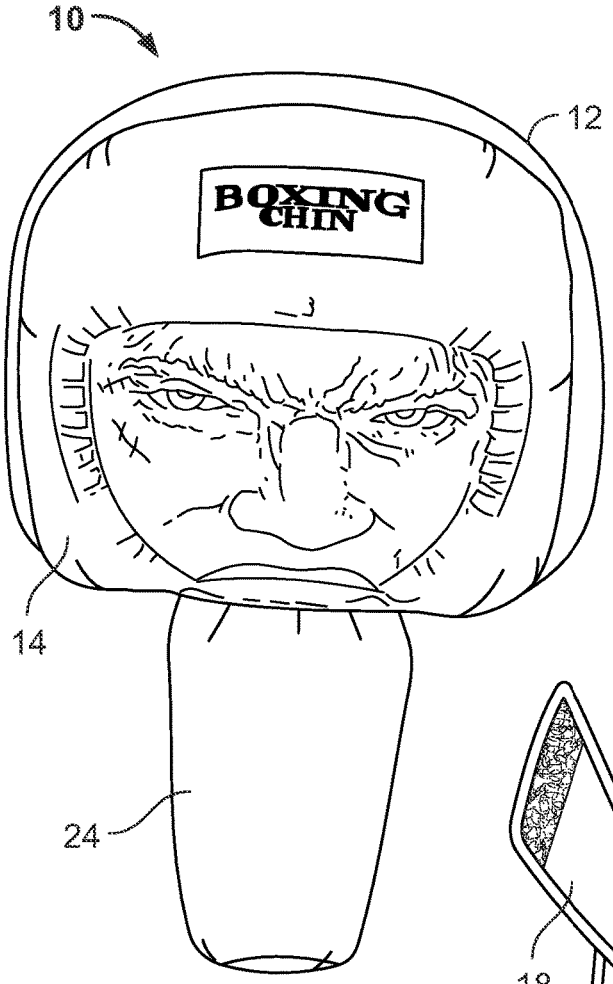
FIG. 1 is a frontal elevational view of the training accessory in accordance with the present invention.
Figure 2:
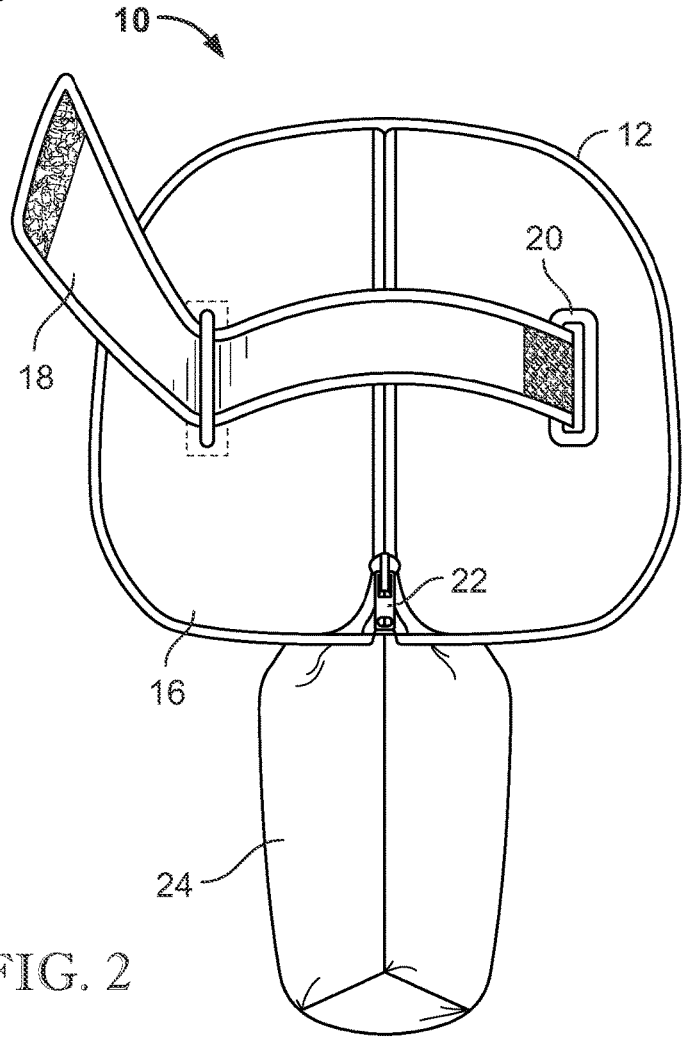
FIG. 2 is a rear elevational view of the training accessory.
Figure 3:
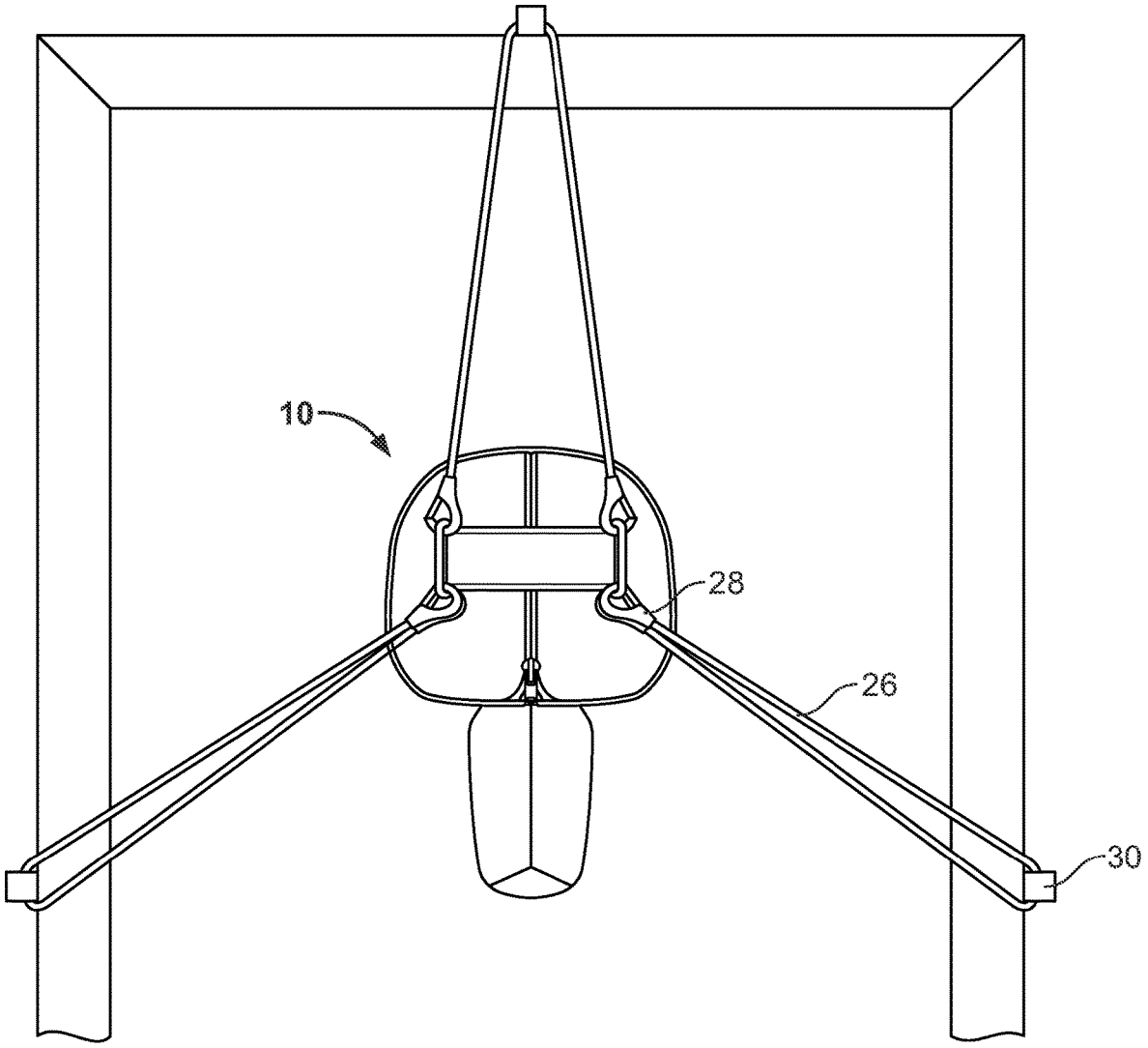
FIG. 3 is a rear elevational view of the training accessory in place and ready for use within a doorway.

10. training accessory
12. padded main body
14. front of the main body
16. rear of the main body
18. handle
20. metal loop
22. zipper
24. chin shaped boxing bag
26. elastic rope
28. hook
30. door moulding hooks
32. wall mounting bracket
34. bolt
36. bottom of the main body
38. opening at the lower end of the main body
40. core
44. interior cushion material of the main body Referring now to the drawings, FIGS. 1-3 and 5-9 illustrate a training accessory, generally referenced at numeral 10. The training accessory 10 comprises a padded main body 12 having a front side 14 and a rear side 16. The padded main body 12 is covered with leather or a similar material, which is enclosed with a zipper 22 on the rear side 16. The front side 14 has an image of a human face, excluding a lower jaw, printed on it, as seen in FIG. 1. The rear side 16 has a handle 18 with a hook and loop fastening system that goes through a metal loop 26 and overlaps itself, as seen in FIGS. 2 and 3.

The main body 12 has a small boxing bag 24 attached to the core of the main body 12, which hangs somewhat freely so it can move when punched. The boxing bag 24, is made of leather and filled with sand. The boxing bag 24 when attached to a main body 12, represents a human chin that makes the imitation and look of the human face complete on the front side 14 of the training accessory 10.

As seen in FIG. 3 the training accessory 10 is attached to a moulding of an open doorway with elastic rope 26 attached to door moulding hooks 30 and hooks 28 attached to the metal loops 20 on the rear side 16 of the main body 12.

Figure 4:
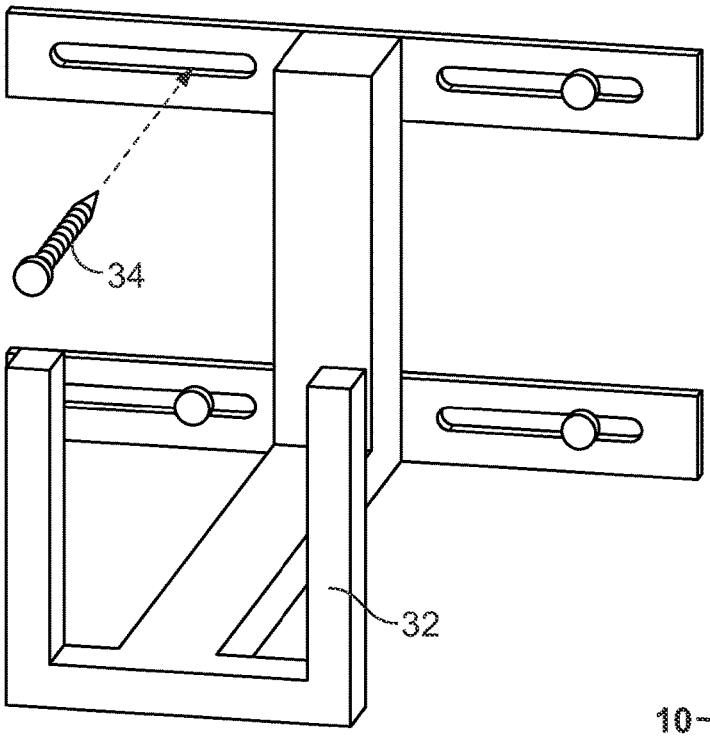
FIG. 4 is a front perspective view of the wall-mounting bracket.
Figure 5:
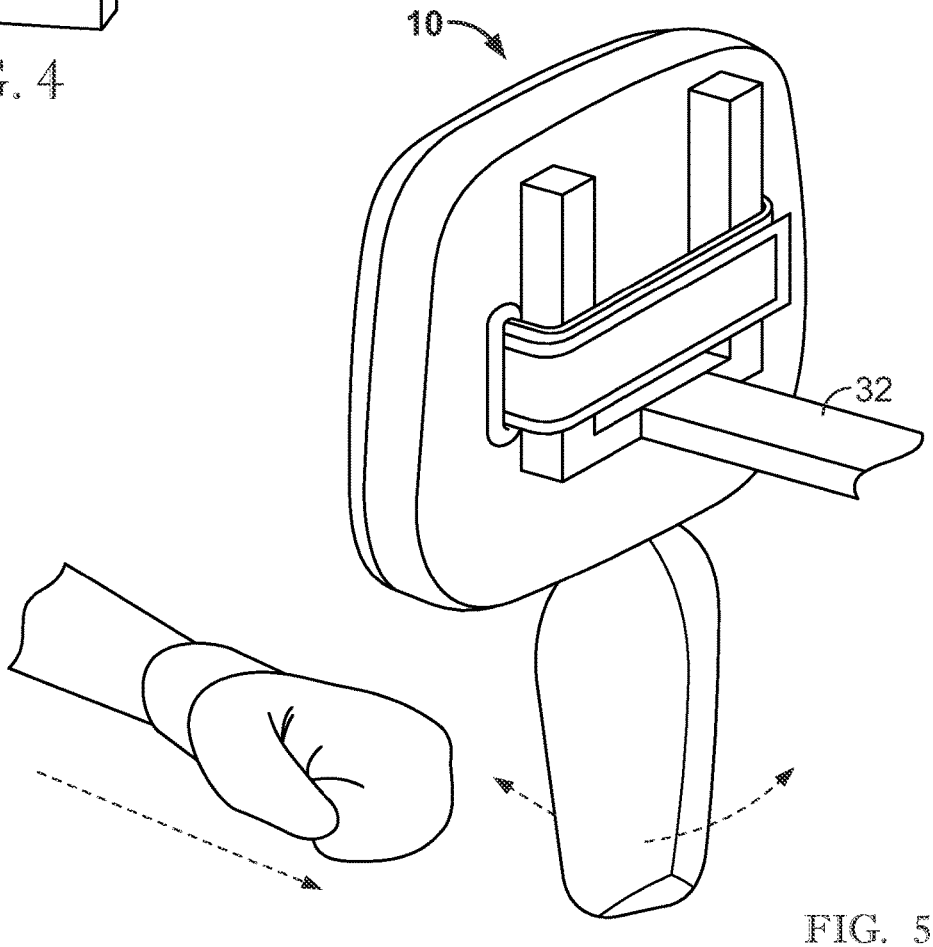
FIG. 5 is a rear perspective view of the training accessory that is attached to a wall mounting bracket.
Figure 6:
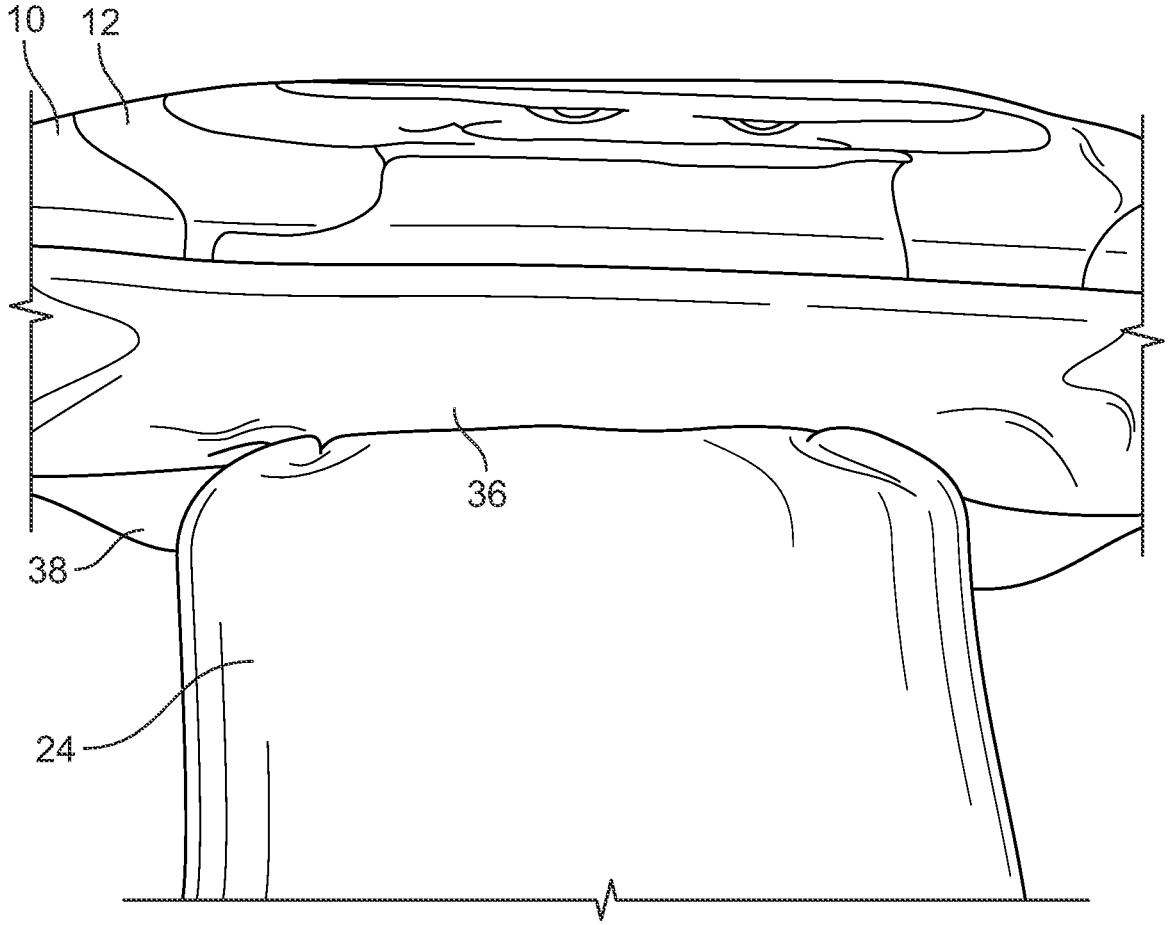
FIG. 6 is a partial bottom front perspective view of the training accessory.
Figure 7:
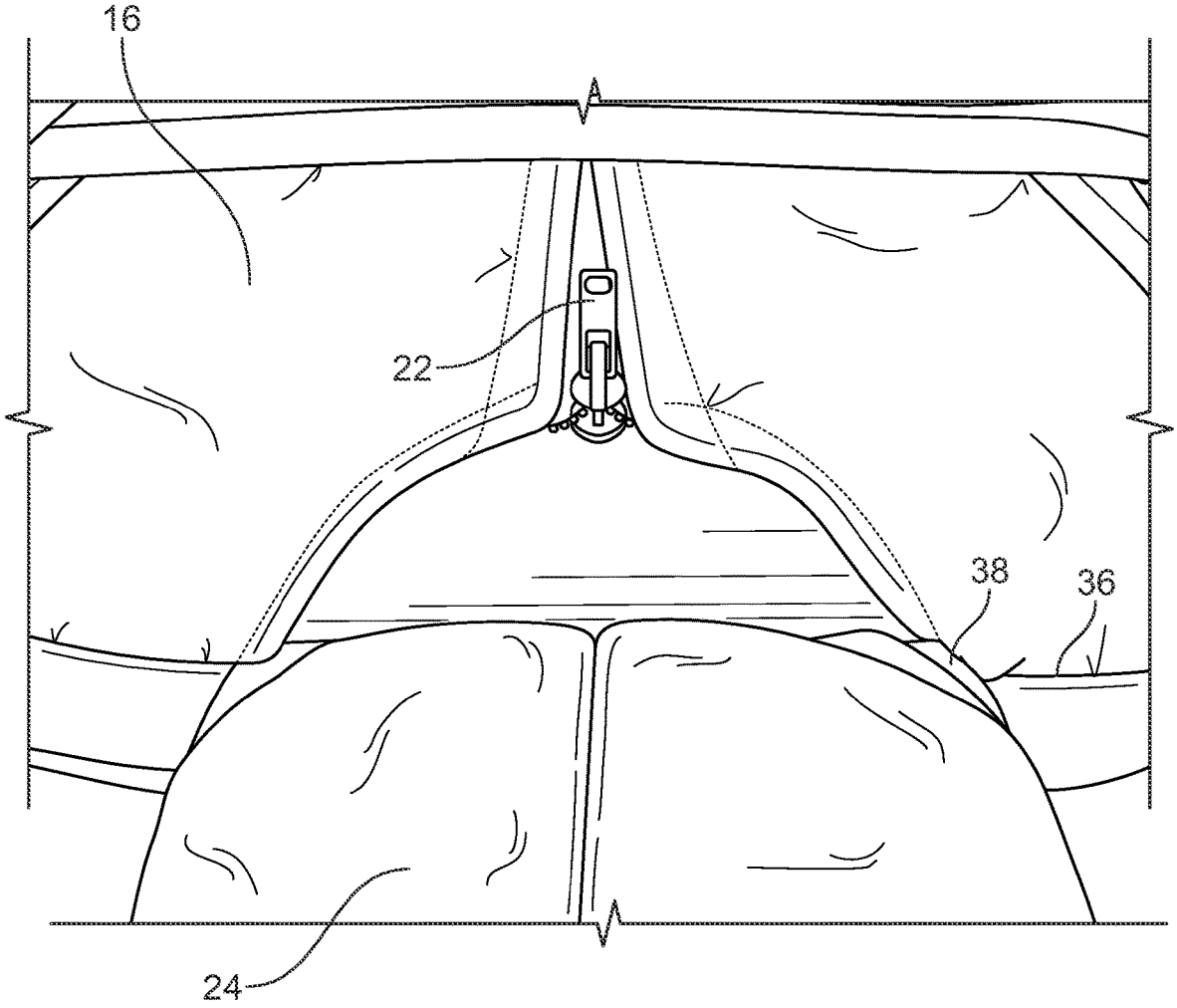
FIG. 7 is a partial rear bottom perspective view of the training accessory.
Figure 8:
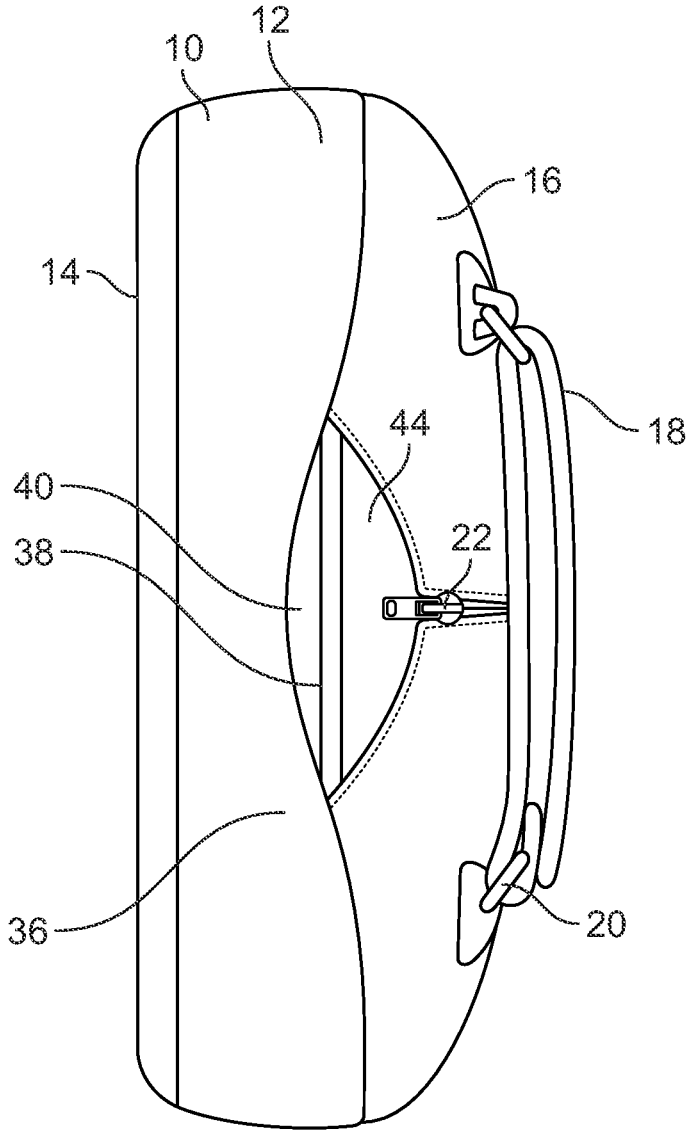
FIG. 8 is a bottom elevational view of the main body of the training accessory.
Figure 9:
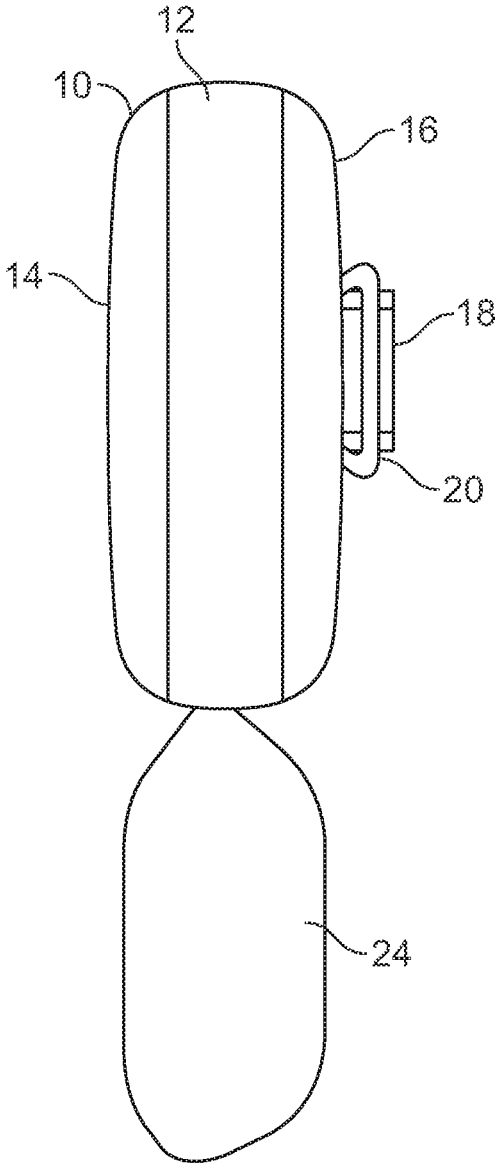
FIG. 9 is a side elevational view of the training accessory.

The training accessory 10 can also be attached to a wall with a wall-mounting bracket 32, that is attached to a studs in a wall by bolts 34, as seen in FIGS. 4 and 5. FIG. 5 also illustrates a user striking the boxing bag 24 with a boxing glove covered fist.

The present invention provides a handheld boxing training equipment (training accessory 10), that is a kind of handheld punching pad/mitt (main body 12) with a handle 18 on the back (the rear 16 of main body 12) that has a small boxing bag (the chin shaped boxing bag 24), referred herein to as "Boxing Chin", hanging from the bottom part of the device (the bottom 36 of the main body 12), which allows the chin shaped boxing bag 24 to move back and forth and side to side when punched, also it has less resistance to the punch than any other handheld boxing training device available now, that helps to prevent a possible injury to the boxer's hand/wrist, joints or muscles, etc. The boxing chin (the chin shaped boxing bag 24) is in similar size and shape of a human chin/jaw. The handheld punchable pad (the main body 12) would have a core 40 that will be made of wood, plastic or other solid but not heavy material, to help keeping the shape and form of the main body 12, which is covered by a cushiony material 44, that would be overlaid leather or similar durable material. The front part of the pad (the front 14 of the main body 12) would be in the shape of a human face or an image of a human face will be printed on it, while the chin/jaw wouldn't be included on the pad. The device would have a handle 18 on the back side the pad (the rear 16 of the main body 12). The hanging boxing chin (the chin shaped boxing bag 24) would be attached to the core 40 of the pad and the device as a whole would complete the imitation of a human face. The boxing chin (the chin shaped boxing bag 24) would be made of leather or other similar durable material and filled with sand, rubber filler or similar material.

As described herein, the device can also be easily attached to a wall-mounted bracket 32 or within any open doorway that has a moulding/casing with the elastic bands or ropes 26. The size and shape of the hanging boxing chin (the chin shaped boxing bag 24) makes it possible to practice precisely the punch to the jaw/chin. The device could be used with a trainer or individually. Exercising with a trainer allows the trainer by holding and moving the device to mimic the opponent's movement (move up or down, retreat, coming forward, move side to side, etc.) while the trainee/student can practice the stroke to the jaw/chin while also moving around. The trainee can practice this stroke/punch at different angles and distances using different techniques, while developing the accuracy, timing and power of the blows delivered, not only by hands, but also by the elbows and feet. Individually the trainees can practice their own movements in front and around the opponent, while practicing the strike to the jaw/chin. The size of the boxing chin will allow the trainee to grind their striking accuracy and develop their own most effective style. In addition, different equipment can be used during the training sessions, such as boxing gloves, sparring glove or hand wraps. The invention is an improvement in the field of martial art training equipment.

In summary, a training accessory for use in boxing or other martial arts comprises:

a padded main body including a front side, and a rear side, a bottom or lower end, and a core;

an opening at the lower end of the padded main body; and a small boxing/punching bag hanging downwardly from a central area of the opening of the main body. The small boxing/punching bag is smaller than the padded main body. The small boxing/punching bag is adapted to imitate a human chin/jaw, being similar in size and shape to a human chin/jaw. The small boxing/punching bag is attached to the core of the padded main body.

In some embodiments, the training accessory further comprises an image of a face excluding a jaw on the front side of the padded main body, whereby the padded main body represents a human face excluding a lower jaw and the small boxing/punching bag represents the human chin/jaw.

In some embodiments, the training accessory further comprises a handle, wherein the handle is configured to allow a user's hand to be inserted or attached to the rear side of the padded main body.

In some embodiments, the training accessory further comprises an attachment between an open doorway The attachment comprises mechanical fasteners attached to the rear side of the said padded main body The mechanical fasteners that are attached to the rear side of the said padded main body, are attached to at least two stretchable ropes, each of said at least two stretchable ropes comprising a first end with a first hook and a second end with a second hook, wherein the at least two stretchable ropes are attached to at least two door moulding hooks attached to the open doorway.

In some embodiments, the training accessory further comprises an attachment to a wall-mounting bracket or frame, wherein: a training accessory is attached to the wall-mounting bracket with a mechanically fastened handle that is attached to the rear side of said padded main body.

While number of exemplary aspects and embodiments have been discussed above, those of skill in the art will recognize certain modifications, permutations and additions and sub combinations thereof. It is therefore intended that the following appended claims and claims herein after introduced are interpreted to include all such modifications, permutations, additions and subcombinations that are within their true spirit and scope.

What is claimed is:

1. A training accessory for use in boxing or other martial arts comprising:

a padded main body including a front side, a rear side, and a core;

an opening at the lower end of the padded main body; and a boxing/punching bag hanging downwardly from a central area of said opening of said main body, the boxing/punching bag being adapted to imitate a human chin/jaw, the boxing/punching bag being smaller than the padded main body;

wherein said boxing/punching bag is attached to the core of said padded main body.

2. The training accessory of claim 1, further comprising an image of a face excluding a jaw on the front side of said padded main body, whereby the padded main body represents a human face excluding a lower jaw and the boxing/punching bag represents the human chin/jaw.

3. The training accessory of claim 1, further comprising a handle, wherein the handle is configured to allow a user's hand to be inserted or attached to the rear side of the padded main body.

4. The training accessory of claim 1, further comprising an attachment between an open doorway, said attachment comprising:

mechanical fasteners attached to the rear side of the padded main body;

the mechanical fasteners that are attached to the rear side of the padded main body, are attached to at least two stretchable ropes, each of said at least two stretchable ropes comprising a first end with a first hook and a second end with a second hook, wherein the at least two stretchable ropes are attached to at least two door moulding hooks attached to the open doorway.

5. The training accessory of claim 1, further comprising an attachment to a wall-mounting bracket or frame, wherein: the training accessory is attached to the wall-mounting bracket with a mechanically fastened handle that is attached to the rear side of said padded main body.

* * * * *